US012378733B1

(12) United States Patent
Guinn et al.

(10) Patent No.: US 12,378,733 B1
(45) Date of Patent: Aug. 5, 2025

(54) BRIDGE DECK PAVER WITH ENHANCED HYDRAULIC SHIFTING

(71) Applicant: Allen Engineering Corporation, Paragould, AR (US)

(72) Inventors: Timmy D. Guinn, Paragould, AR (US); Michael W. McKean, Arlington, TN (US)

(73) Assignee: Allen Engineering Corp., Paragould, AR (US)

( * ) Notice: Subject to any disclaimer, the term of this patent is extended or adjusted under 35 U.S.C. 154(b) by 910 days.

(21) Appl. No.: 17/545,518

(22) Filed: Dec. 8, 2021

Related U.S. Application Data

(60) Provisional application No. 63/123,537, filed on Dec. 10, 2020.

(51) Int. Cl.
*E01C 19/28* (2006.01)

(52) U.S. Cl.
CPC ..... *E01C 19/286* (2013.01)

(58) Field of Classification Search
CPC ..... E01C 19/29; E01C 19/41; E01C 19/26; E01C 19/40; E01C 19/4853; E01C 19/38; E01C 19/282; E01C 19/286; E01C 23/03
See application file for complete search history.

(56) References Cited

U.S. PATENT DOCUMENTS 4,256,415 A * 3/1981 Rowe ..... E01D 21/00 404/116
4,314,773 A 2/1982 Allen
4,685,826 A * 8/1987 Allen ..... E01C 19/405 404/114
4,702,640 A 10/1987 Allen
4,741,643 A * 5/1988 Allen ..... E01C 19/405 404/114
4,775,262 A 10/1988 Guntharp
4,993,869 A 2/1991 Ulmer
5,328,295 A 7/1994 Allen
5,352,063 A 10/1994 Allen
5,492,432 A 2/1996 Eben
(Continued)

OTHER PUBLICATIONS

Bid-Well Corporation, Bid-Well 4800, Concrete Paving Machine, Jan. 1, 2008, Canton, South Dakota 57013 USA (16 megabyte copy attempted to be uploaded to USPTO herewith . . . ).

*Primary Examiner* — Abigail A Risic
(74) *Attorney, Agent, or Firm* — Stephen D. Carver

(57) ABSTRACT

A concrete bridge deck finishing machine for bridge deck construction and repairs comprises an elongated, horizontally extending box frame in the general form of a parallelepiped, which is elevated above a deck or roadway to be finished by a plurality of vertically upright, adjustable jack stands that are propelled hydraulically to traverse roadway surfaces, travel rails or forms. A reciprocating carriage suspended from the frame controls a downwardly suspended finishing head apparatus that contacts the concrete surface below for striking off, densifying and/or finishing. The carriage transversely moves back and forth in response to hydraulic circuitry actuated by a plunger driven ramp that separately controls the rate of machine propulsion, carriage traversing speed, carriage deceleration, and the direction of carriage travel. Carriage travel and reversing is synchronized with proper roadway travel commands from mechanically triggered hydraulic valves.

10 Claims, 16 Drawing Sheets

(56) References Cited

U.S. PATENT DOCUMENTS

| | | | | |
|---|---|---|---|---|
| 5,562,361 | A | 10/1996 | Allen | |
| 5,988,939 | A * | 11/1999 | Allen | E01C 19/38 404/115 |
| 6,055,486 | A * | 4/2000 | Minnich | E01C 19/407 702/56 |
| 6,234,713 | B1 * | 5/2001 | Rowe | E01C 19/29 404/116 |
| 6,497,531 | B2 | 12/2002 | Sipherd | |

* cited by examiner

BRIDGE DECK PAVER WITH ENHANCED HYDRAULIC SHIFTING

CROSS REFERENCE TO RELATED APPLICATION

This utility conversion patent application is based upon U.S. Provisional application Ser. No. 63/123,537, filed Dec. 10, 2020, entitled "Bridge Deck Paver with Enhanced Hydraulic Shifting," by co-inventors Timmy D. Guinn (American Citizen) and Michael McKean (American Citizen), and priority based thereon is claimed.

BACKGROUND OF THE INVENTION

I. Field of the Invention

The present invention relates generally to mechanized pavers for roadbeds or bridge decks. More particularly, the present invention relates to bridge deck pavers for laying down and shaping raw concrete over bridge decks or road beds, with improved hydraulic actuation controls for operating the reciprocating carriage and the propulsion motors and pumps.

II. Description of the Prior Art

With the aging and resultant degradation of the domestic infrastructure and especially bridges, the repair and resurfacing of bridges with modern powered equipment has become increasingly popular. A variety of finishing devices such as strike-offs, screeds, vibrating screeds, roller screeds or pavers, and bridge deck pavers are known in the concrete arts. Systems exist for pouring, striking off, conveying, vibrating and finishing concrete in strips approximating the size and the width of a typical two or four lane bridges.

It is well recognized in the art that wet or plastic concrete must be processed or finished soon after pouring and before significant hardening, to achieve desirable characteristics. Wet concrete is normally discharged from above and poured between spaced-apart forms that may border and traverse regions to be paved, such as bridge decks and the like. Usually wet concrete is poured immediately in front of a concrete finishing machine that may be supported by spaced-apart concrete forms that function as supporting guide rails. Modern finishing machines may ride on their own wheels without forms. Various propulsion means may be employed for machine displacement over supports for travel along the deck length. For best results, it preferred to vigorously vibrate green concrete during pouring to facilitate desirable concrete consolidation.

The concrete deck forming the top of a typical bridge can be formed with various bridge deck and concrete placement apparatus. The concrete deck may require specific dimensions, and a specific angular crown. Automated bridge deck and concrete finishing and forming machines for quickly and efficiently laying down significant lengths of concrete are thus desirable.

Allen Engineering Corporation has previously developed concrete finishing machines that can use rigid, horizontally disposed, support frames, such as box frames or triangular truss frames. These can support various tool arrangements that hang down and contact wet concrete. Allen U.S. Pat. No. 4,249,327, for example, discloses a rigid, elongate triangular truss frame.

Besides well-known screed and strike-off elements, rollers are known. For example, a roller-tube finishing machine is seen in U.S. Pat. No. 4,314,773 issued Feb. 9, 1982 and owned by the present assignee. It discloses a form-riding, concrete placement and finishing machine comprising multiple roller tubes, that is positioned above an area into which wet concrete has been poured, for vibrating the concrete mass and finishing the concrete surface.

U.S. Pat. No. 4,702,640 issued Oct. 27, 1987, and also owned by Allen Engineering Corporation, discloses another rotating-tube type concrete finisher.

U.S. Pat. No. 4,775,262 issued Oct. 4, 1988 discloses a vibrating compactor head adapted to be suspended over a roadway by a transverse frame. The surfacing unit comprises finishing cylinders with two augers mounted in line with the cylinders, and a pair of compacting rollers located on either side of the augers.

U.S. Pat. No. 4,993,869 issued Feb. 19, 1991 discloses a concrete finishing machine including multiple finishing rollers equipped with a roller vibrating assembly. Vibration is applied to the finishing rollers through the frame, the vibrator units being mounted on a common beam and spaced apart laterally of one another whereby horizontal forces are canceled and only vertical amplitude vibrational forces are applied to the finishing rollers.

U.S. Pat. No. 5,328,295 issued Jul. 12, 1994 discloses a concrete finishing machine that is capable of controlling a variety of different elongated, multi-section concrete finishing tools such as vibratory screeds or the like, with or without forms. Skis that support the device facilitate sliding, winch driven movement over and through plastic concrete. Spaced apart, vertically upwardly extending towers disposed periodically along the length of the frame support the finishing tool. An upper strut extends between the stanchions. A sleeve coaxially fitted to each stanchion is synchronized with the opposite sleeve by a rigid transverse bridge. Winches move the device along the plastic concrete by spooling cables secured to a fixed point.

U.S. Pat. No. 5,352,063 issued Oct. 4, 1994 discloses a self-propelled polymer paver that distributes, consolidates, places and finishes polymer concrete to rapidly resurface roadbeds. A mobile, wheeled chassis mounts an adjustable hopper that receives premixed polymer from a mixer truck that precedes the paver. A finishing assembly secured to the chassis has a distribution assembly for applying concrete transversely across the surface, and a trailing finishing screed that surfaces and densifies the concrete. An active, hydraulic suspension dynamically orients the chassis and the finishing assembly with the roadbed. Individual height adjusting cylinders can be extended or contracted by an automatic grade control that logically senses grade through an external string line. The distribution system comprises an open bottom exposing the surface to be paved, and an open top adapted to receive concrete from a trough extending from the hopper. A bidirectional auger is rotatably disposed within a distribution box for moving concrete upon the surface. The finishing screed comprises a rigid strike off that initially contacts uncompacted concrete laid by the distribution system. An intermediate pan extending between the strike off and a trailing bull float mounts a plurality of vibrators that facilitate concrete densification.

U.S. Pat. No. 5,492,432 issued Feb. 20, 1996 discloses a concrete vibrating apparatus for use in a finishing machine similar to the instant invention. Said finishing machine includes a finishing head that engages and finishes the surface of the concrete that moves transversely across the roadway during finishing. The finishing head is suspended from a transverse frame that is supported by jack stands on opposite frame ends. The jack stands are propelled by lower motors traversing suitable support rails on opposite sides of the road bed. A vibrator assembly extends elements below the surface of the concrete for concrete consolidation.

U.S. Pat. No. 5,562,361 issued to Allen Engineering Corporation on Oct. 8, 1996 discloses a powered, form-riding, finisher that uses a trio of rotating tubes to strike-off, screed and finish concrete.

U.S. Pat. No. 5,791,815 issued Aug. 11, 1998 and entitled "Vibrating compactor assembly for use with a concrete finishing machine" is similar to U.S. Pat. No. 4,775,262 discussed above.

U.S. Pat. No. 6,234,713 issued May 22, 2001 discloses a concrete machine comprising an elongated box-like frame suspended over a road bed surface that supports a traversing concrete finishing head, and a vibrator assembly that is longitudinally displaced along a poured concrete road bed. The paving machine finishing carriage unit moves transversely back and forth across the concrete.

U.S. Pat. No. 6,497,531 issued Dec. 24, 2002 discloses a concrete curing and texturing machine includes a truss frame and drive members positioned at the ends of the frame for powering the machine longitudinally along a roadway being surfaced. A texturing carriage is mounted to the truss frame and arranged to longitudinally move back and forth along the truss frame, traversing the roadbed from side to side.

Also, the Terex-Bidwell company of Canton South Dakota has previously marketed roadbed pavers under the model numbers 3600 and 4800.

From an operational standpoint, relatively large, mechanized roadbed finishers can be impractical for smaller road bed projects Popular units typically comprise an elevated, transverse frame that moves longitudinally along and above a road bed to be paved, and which supports a lower, transversely reciprocating finishing head. Such machines have presented service and reliability problems because of hydraulic complexity. For example, it has hitherto been a problem controlling finishing machine drive apparatus for achieving proper machine speed as it moves along the roadway, while at the same time controlling proper transverse movements of the suspended finishing head. Proper timing is needed for synchronizing movements of the machine along a roadbed with movements of the suspended finishing head transversely back and forth across the concrete slab. The latter problem can be aggravated further when a serious crown must be imparted to the road bed.

Therefore a system establishing independent hydraulic control of the traversing carriage and its finishing head(s) is suggested. However, it must not interfere with or occlude operation of the main drive motors on the jack stands that support the traveling frame. Timing must be properly established.

In other words, as conventional paver machines are propelled longitudinally along the road bed, with the suspended carriage reciprocating transversely back and forth, irregularities can occur because of hydraulic circuitry limitations. Normally the hydraulic circuitry controls the rate of machine propulsion and the carriage traversing speed. Hitherto these main control functions have been intertwined, so that hydraulic flow rates with one of the sub-circuits can occasionally interfere with control of the other. For example, speed selection of the frame jacks can route hydraulic fluid and/or overload the flow capacity such that the carriage traversing speed becomes irregular and unpredictable. Moreover, temperature extremes aggravate encountered outdoors can aggravate the latter problem.

SUMMARY OF THE INVENTION

A concrete bridge deck finishing machine adapted for bridge deck construction and repairs is equipped with enhanced hydraulic control circuitry.

The bridge deck machine preferably comprises an elongated, horizontally extending truss or box frame in the general form of a parallelepiped. The frame is elevated above a bridge deck, or roadway to be finished by a plurality of supports that can move the device along a roadbed. Preferably a number of vertically upright, adjustable jack stands (i.e., at least four), with one jack stand at each machine corner, are employed. The jack stands are propelled by hydraulically-driven wheels that may run over substantially flat roadway surfaces, or which may engage travel rails or forms that are conventionally provided at opposite sides of the intended deck location prior to concrete treatment. Gross frame and machine locomotion or movements along the roadway pathway are enabled by the hydraulically powered jack stand wheels. The frame supports a slidable carriage that is displaced between frame ends to traverse the road way back and forth at preselected times. Synchronizing carriage travel with roadway travel is accomplish through separate, but related hydraulic circuits.

The carriage supports at least one downwardly extending, longitudinally displaceable concrete treatment head that may be of a variety of different configurations known in the art to accommodate different uses and applications. The selected head, once deployed, can convey or strike-off concrete, and/or consolidate, smooth and or shape the road bed depending upon the intended use and/or the selected configuration.

However, the carriage and the frame propulsion wheels must be independently controlled such that irritating irregularities in carriage control are eliminated.

Thus, it is a basic object of the present invention to provide a self-propelled concrete finishing machine for laying down concrete road beds or bridge decks that reliably controls carriage displacements and machine travel to eliminate irregularities.

A related object is thus to prevent bridge deck carriage displacement irregularities and to thereby improve quality control and operator safety.

Another basic object is to gain effective control over the reciprocating carriage and/or the finishing head(s) in a bridge deck finisher to minimize surface marring and irregularities.

Another basic object is to provide a bridge deck machine of the character described that reliably establishes smooth, regular concrete surfaces.

Yet another fundamental object of this invention is to provide a bridge deck machine of the character described that simplifies operation and eases operator stress.

It is also an object to provide a bridge deck finishing machine of the character described that enables field adjustments to adapt the machine to road beds of different sizes and configurations.

A still further object of the invention is to provide a concrete finishing machine of the character described including independent hydraulic circuits for controlling the longitudinal frame speed and finishing head traversing speed.

These and other objects and advantages will appear or become apparent in the course of the following descriptive sections.

BRIEF DESCRIPTION OF THE SEVERAL VIEWS OF THE DRAWINGS

In the following drawings, which form a part of the specification and which are to be construed in conjunction therewith, and in which like reference numerals have been employed throughout wherever reasonably possible to indicate like parts in the various views.

DETAILED DESCRIPTION OF THE PREFERRED EMBODIMENTS

For purposes of disclosure, the entire contents and disclosures of prior U.S. Pat. Nos. 4,702,640, 4,775,262, 4,993,869, 5,328,295, 5,352,063, 5,492,432, 5,562,361, 5,791,815, 6,497,531 and 6,234,713 mentioned above are hereby incorporated by reference as if fully set forth herein.

Figure 1A:
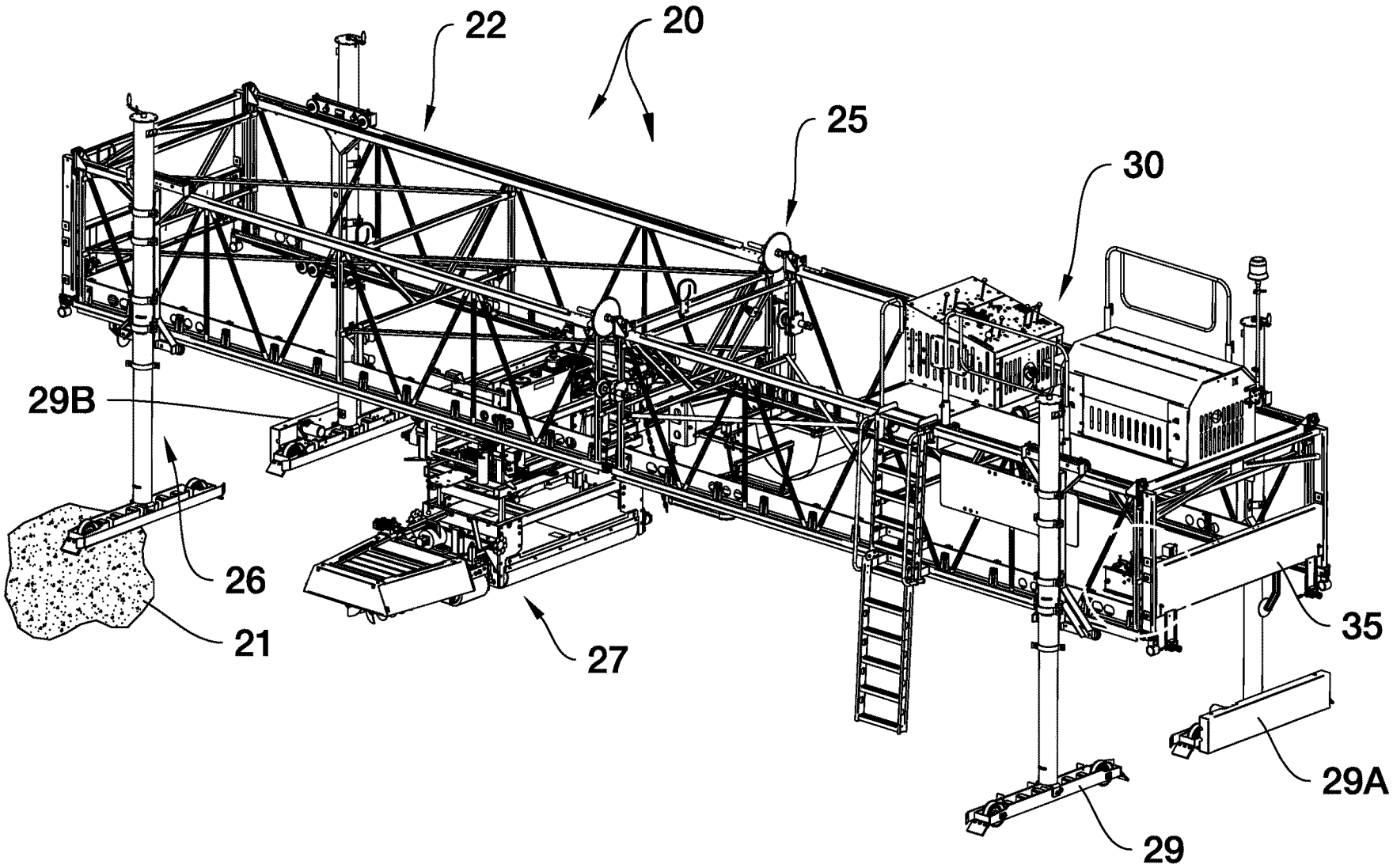
FIG. 1A is a partially fragmentary, frontal isometric view of our new bridge deck finishing machine, showing it in use over a partially completed concrete deck to be treated in accordance with the invention.
Figure 1B:
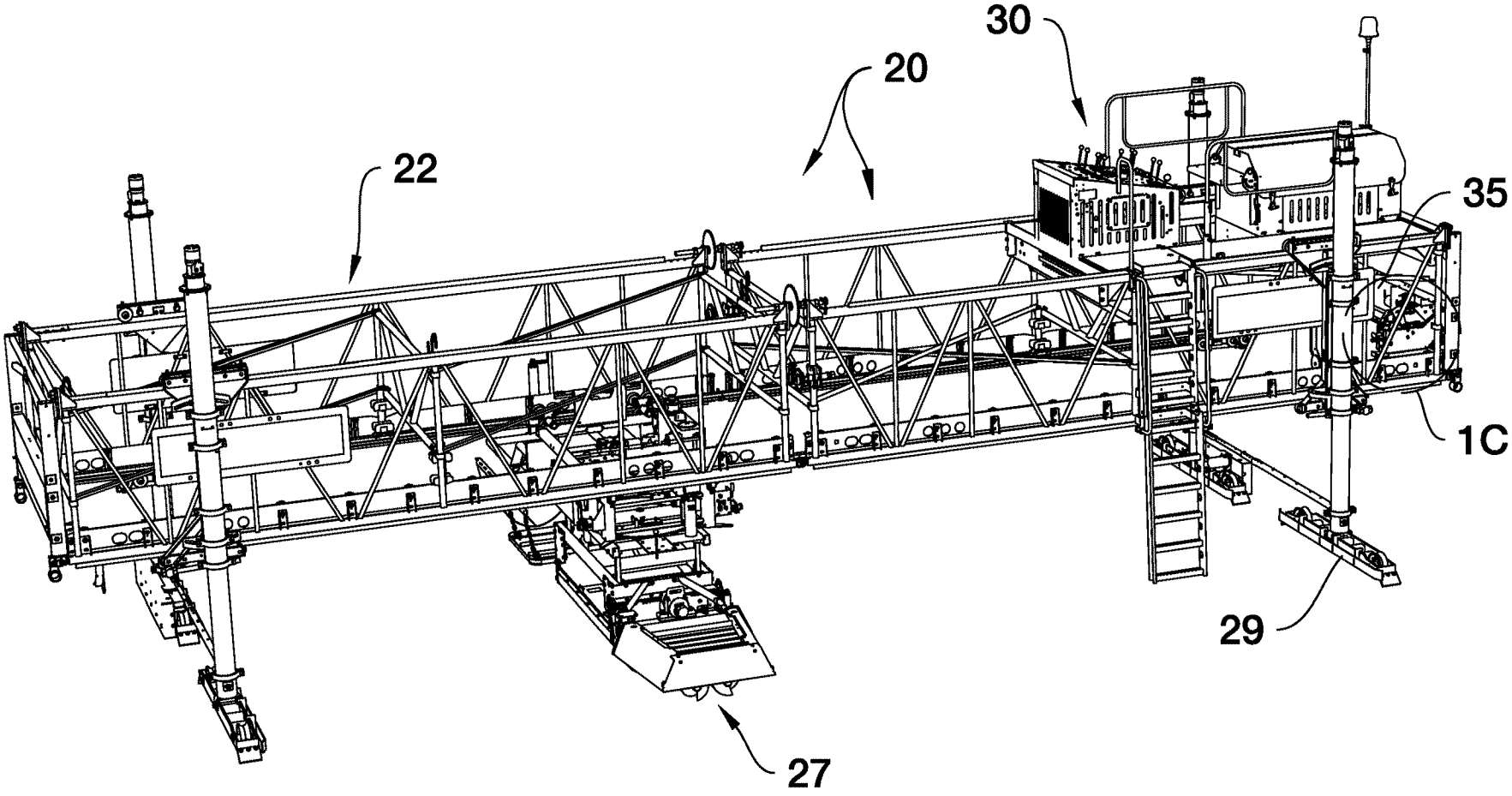
FIG. 1B is a partially fragmentary, rear isometric view of the new bridge deck finishing machine shown in FIG. 1.
Figure 1C:
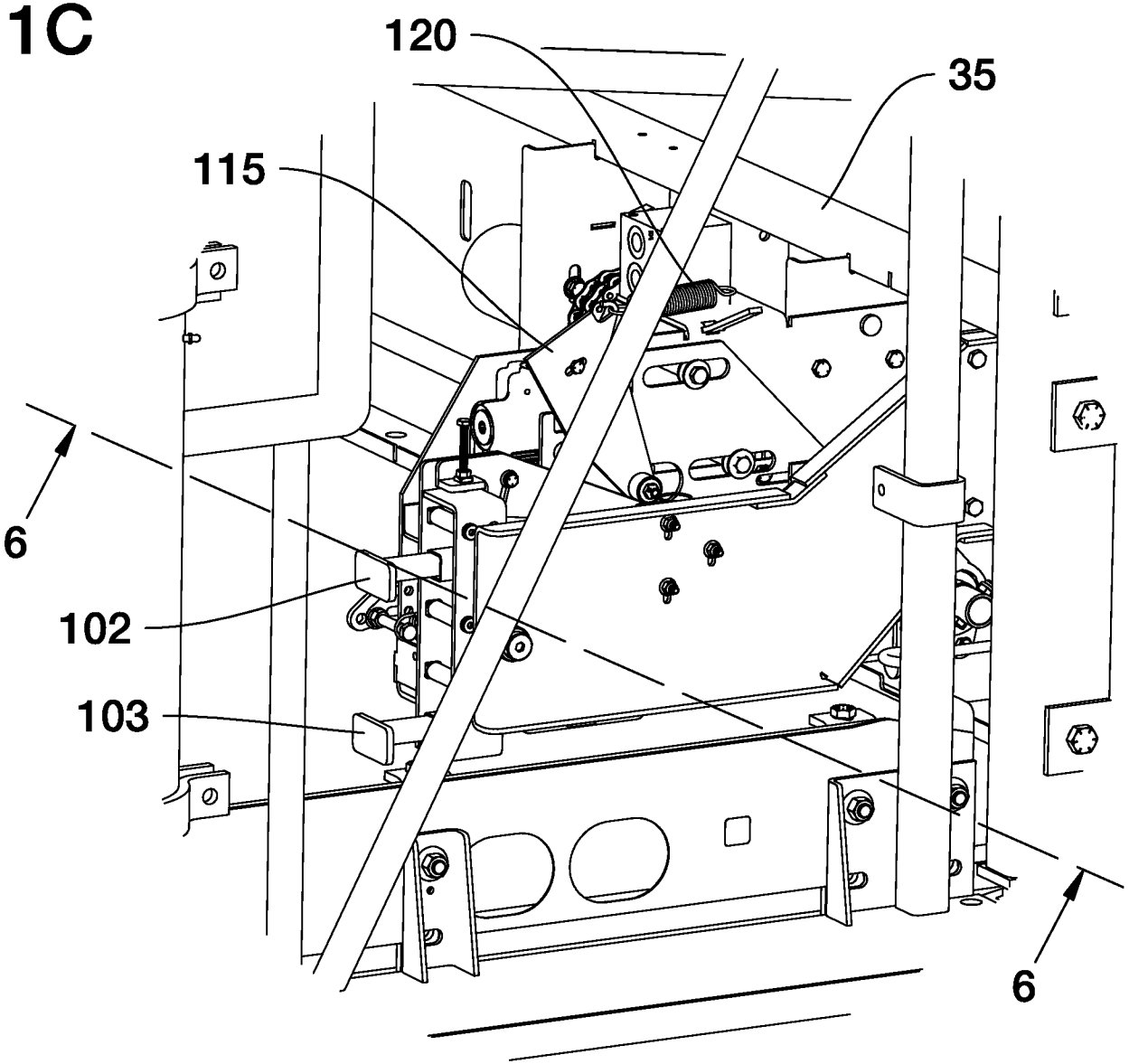
FIG. 1C is an enlarged, fragmentary view derived generally from circled region "1C" in FIG. 1B, with portions thereof broken away or shown in section for clarity.

With initial reference now directed to FIGS. 1A-1C of the appended drawings, a bridge deck paver constructed in accordance with the best mode of the invention known at this time has been generally designated by the reference numeral 20. As will be recognized by those skilled in the art, a partially completed road bed or bridge deck 21 (FIG. 1A) is to be formed and configured by the machine 20 after a concrete pour. Machine 20 comprises an elongated frame 22, generally in the form of a parallelepiped, that is adapted to move along a road bed or region being surfaced. As illustrated, frame 22 is supported at its four corners by a plurality of vertically upright stanchions, preferably in the form of jack stands 26, that are supported by wheeled bogie assemblies 29, at least some of which are propelled by hydraulic motors such as motors 180, 181 (FIG. 11) discussed later. Preferably the frame 22 comprises optional crown control apparatus 25 that adjusts the angularity of the frame, as is recognized in the art.

Figure 6:
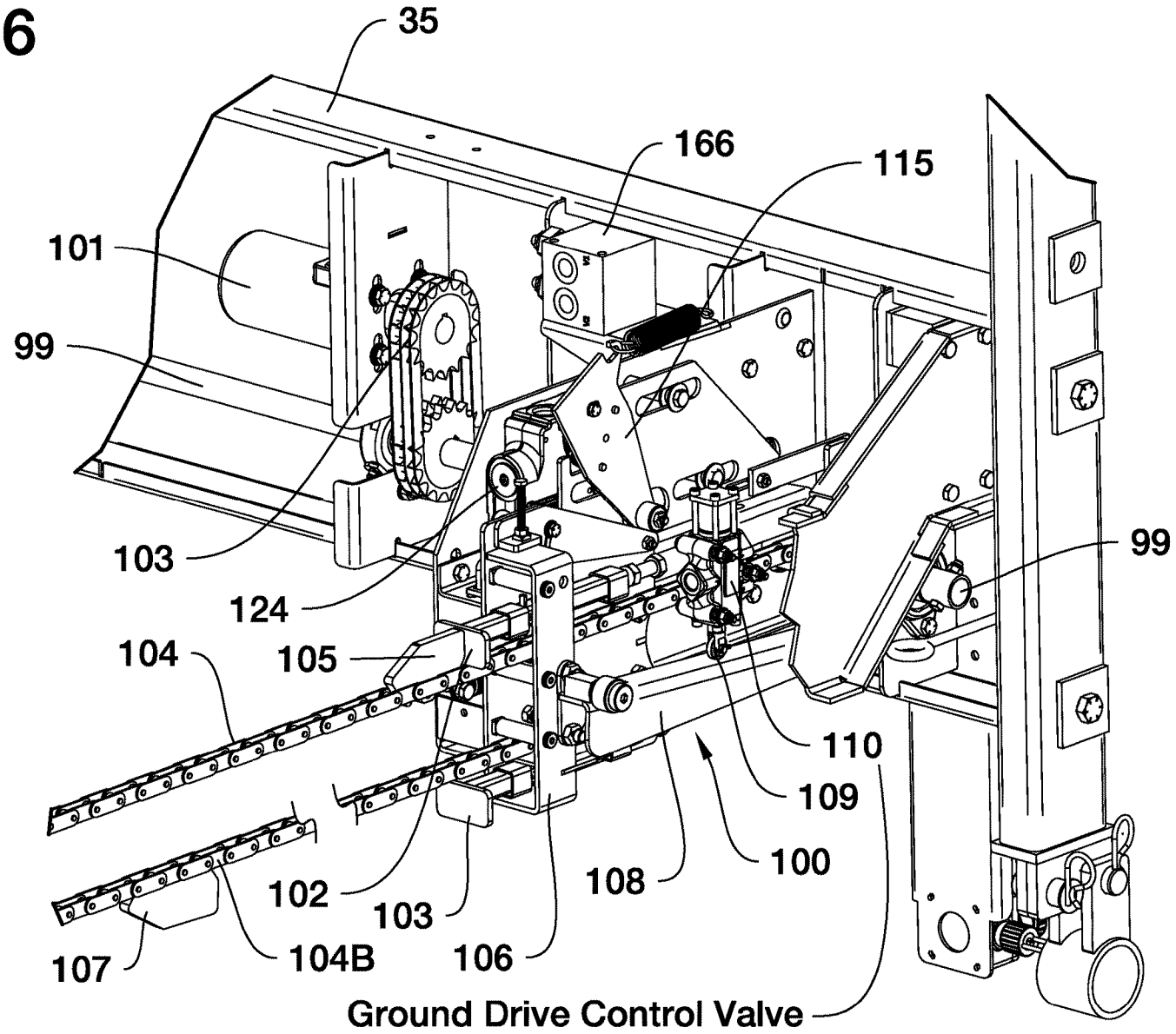
FIG. 6 is an enlarged, fragmentary isometric view derived generally from section line from 6-6 in FIG. 1C in the direction of the arrows, with portions thereof shown in section, omitted or broken away for clarity and brevity.
Figure 7:
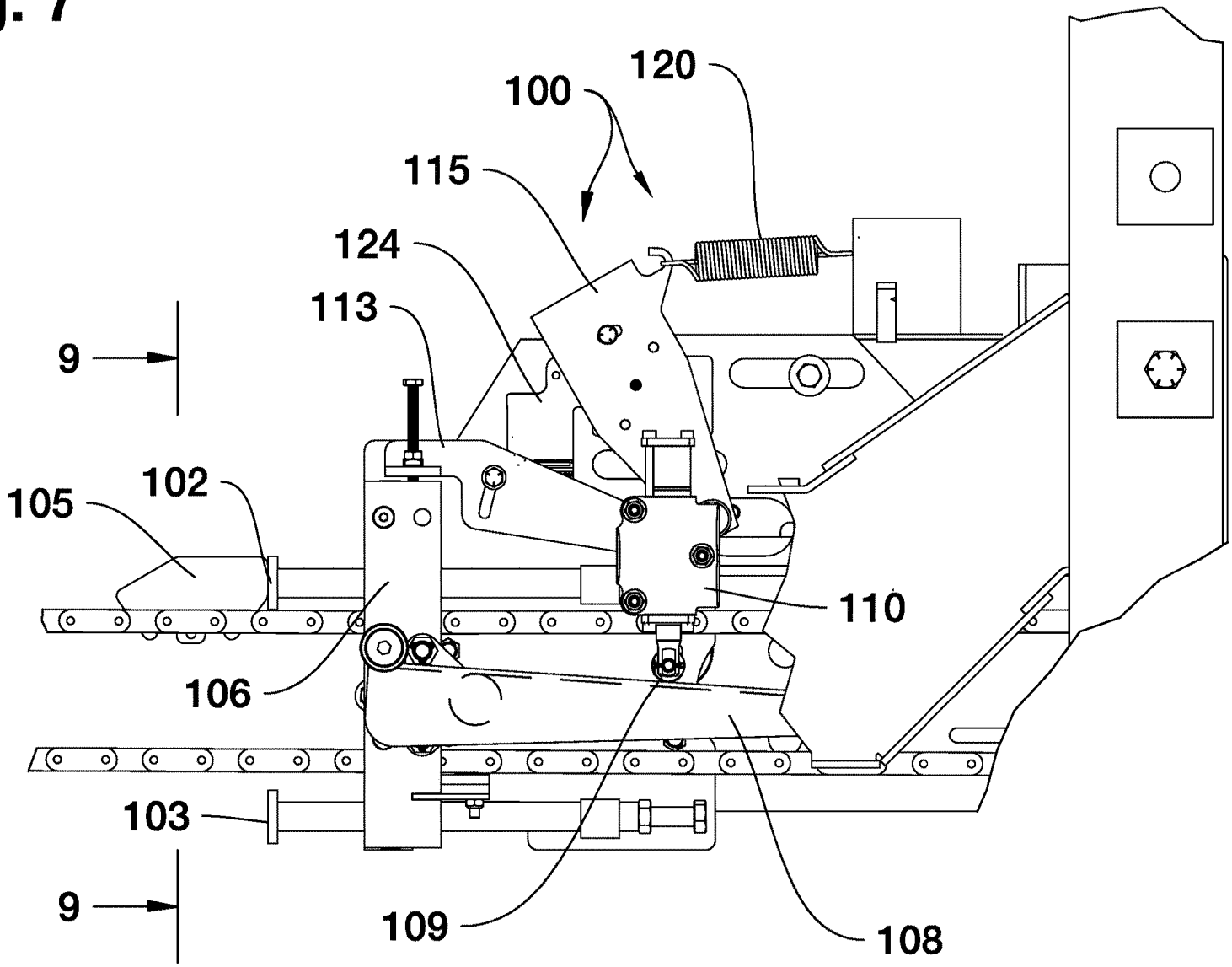
FIG. 7 is a further enlarged, fragmentary plan view derived from FIG. 6, showing hydraulic control details, with portions thereof omitted for brevity or broken away for clarity.

A displaceable carriage 27 that engages and treats raw concrete is suspended from the frame 22. The carriage 27 is reciprocated along the length of the machine 20, being periodically drawn back and forth transversely across the road bed 21 for surface finishing. After the finishing machine 20 reaches and stops at a desired spot, carriage 27 may be displaced for transversely finishing that region. After finishing a given spot, the machine 20 again moves over the roadbed or bridge surface being finished to a spaced-apart spot for finishing that region. In this instance at least one elongated chain 104 (FIG. 6) is disposed within the frame and routed over suitable drive gears, pulleys and guides such that movement of the chain can displace the carriage 27 back and forth along the length of the frame 22, as is known in the art. Hydraulic means are provided for driving the chain(s). As seen in FIGS. 6 and 7, as is discussed below, the front chain 104 interacts with the new hydraulic control circuitry disclosed herein. Carriage 27 may take on a variety of configurations and designs known in the art and disclosed, for example, in several of the above-cited patents. The particular carriage configuration is not vital to this invention, as long as the carriage is operationally coupled to and suspended by the frame 22 over a region 21 to be finished, and as long as it is adapted to be displaced along the frame to contact and finish concrete below with its particular forming or finishing tool or apparatus.

Figure 2:
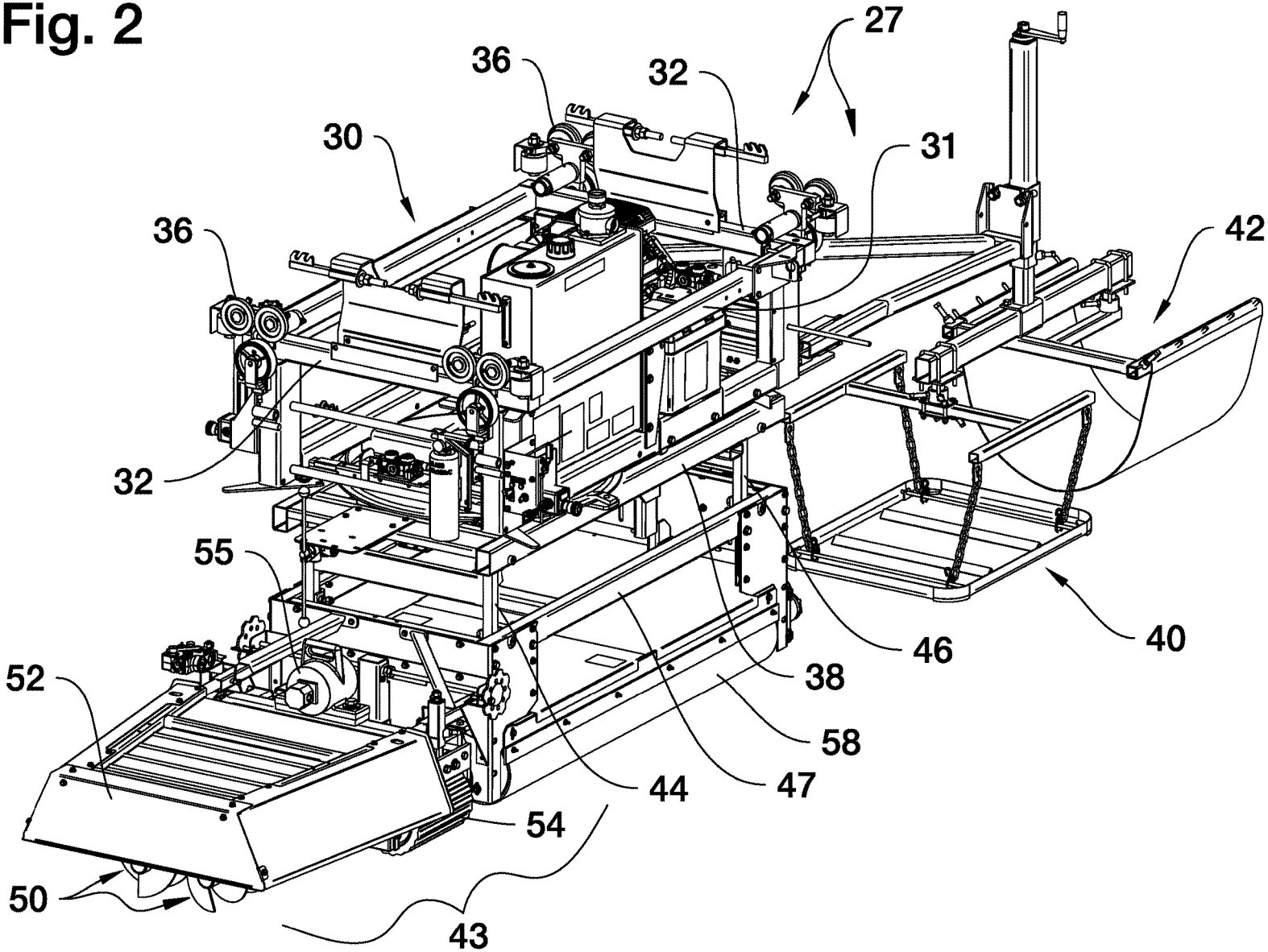
FIG. 2 is an enlarged, fragmentary, isometric view of a typical carriage and a lower finishing head adapted to be deployed by the instant bridge deck finisher.

Referencing FIG. 2, carriage 27 comprises a rigid, box like subframe 30 comprising sides 31 and rigid, transverse end cross pieces 32 that secure suspension wheels 36 that hang the carriage on the frame 22. Lower frame portions 38 of the subframe 30 support an outwardly extending finishing plate 40 and an adjacent surface contouring tool 42.

The finishing head carried by the carriage 27 has been generally designated by the reference numeral 43 (FIG. 2). It is suspended from the carriage by a subframe comprising corner stanchions 44 and additional cross braces 47. The head 43 comprises a pair of spaced apart finishing augers 50 substantially covered by a shroud 52, an adjacent vibrating roller-surfacer 54, and at least a pair of roller tubes 58 oriented generally transversely to the frame 22. A preferably hydraulic vibrator 55 vibrates the roller-surfacer 54 to help densify the concrete. Suitable hydraulic flow lines, pumps and valves known in the art can control the head 43 and its accessories as desired.

Figure 3:
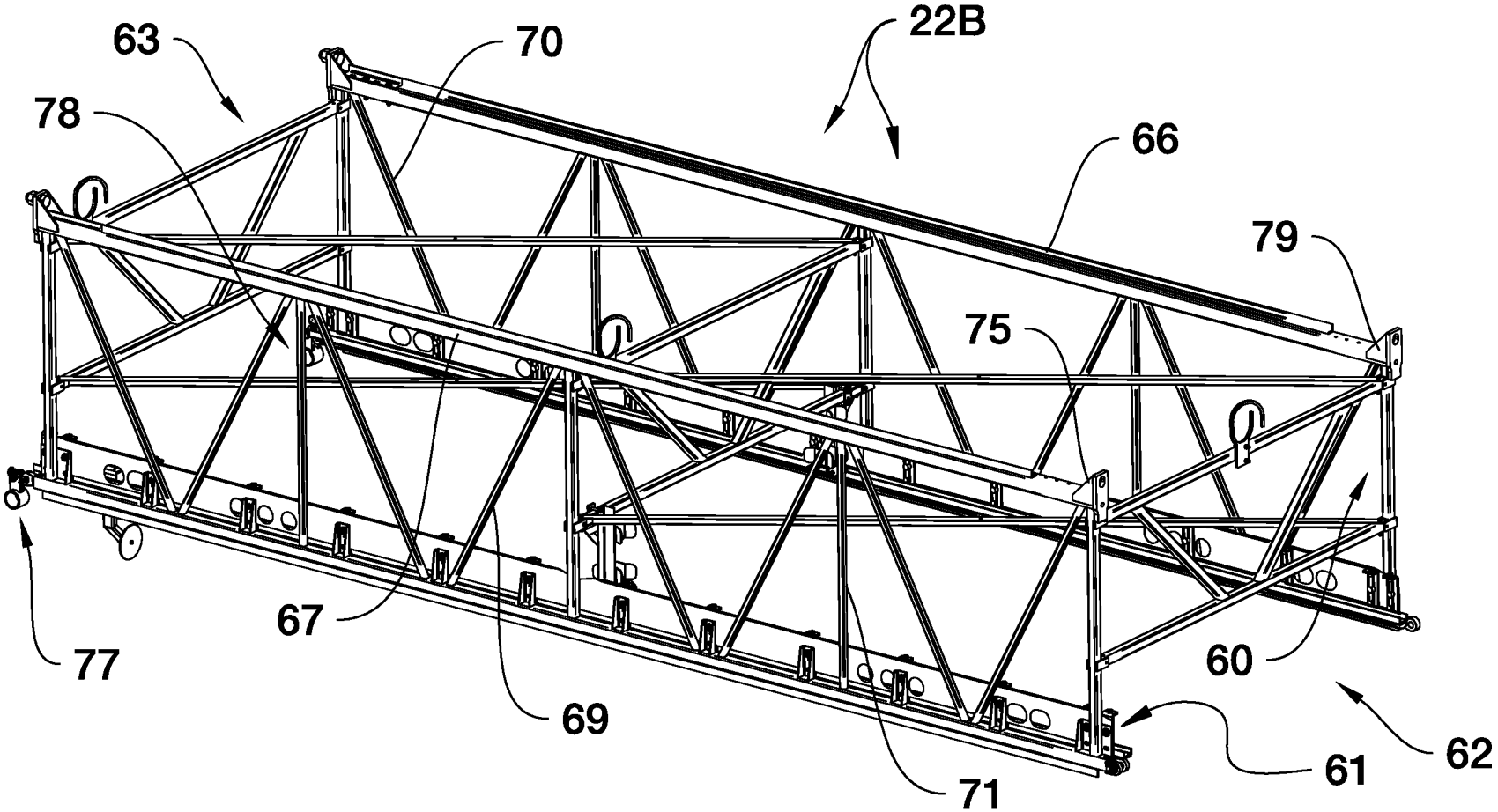
FIG. 3 is an enlarged isometric view of a typical frame segment.

With joint reference now directed to FIGS. 1A and 3, the machine frame 22 can comprise one or more elongated box frame segments 22B that can be coupled together to form a frame 22 of a desired length. The composite frame 22 (FIG. 1) internally receives and suspends the carriage 27 (FIG. 2) for slidable movements along its length. Each frame segment 22 (FIG. 1) is generally rectilinear in appearance, in the form of a parallelepiped. Each has a pair of spaced apart sides 60 and 61 and spaced-apart ends 62 and 63. The upper side rails 66 and 67 braced and maintained in spaced apart, parallel relation by multiple frame braces 69, 70 and 71. The upper frame segment side rails 66 and 67 may support suitable carriage rails for suspending the carriage 27 wherein carriage wheels 36 (FIG. 2) may ride upon and be suspended from such rails or tracks. Suitable conventional and complimentary subframe couplings 75, 76, 77, 78 and 79 (FIG. 3) enable multiple, adjoining frame segments 22B to be quickly joined together to form the composite frame 22 with the desired length.

Figure 4:
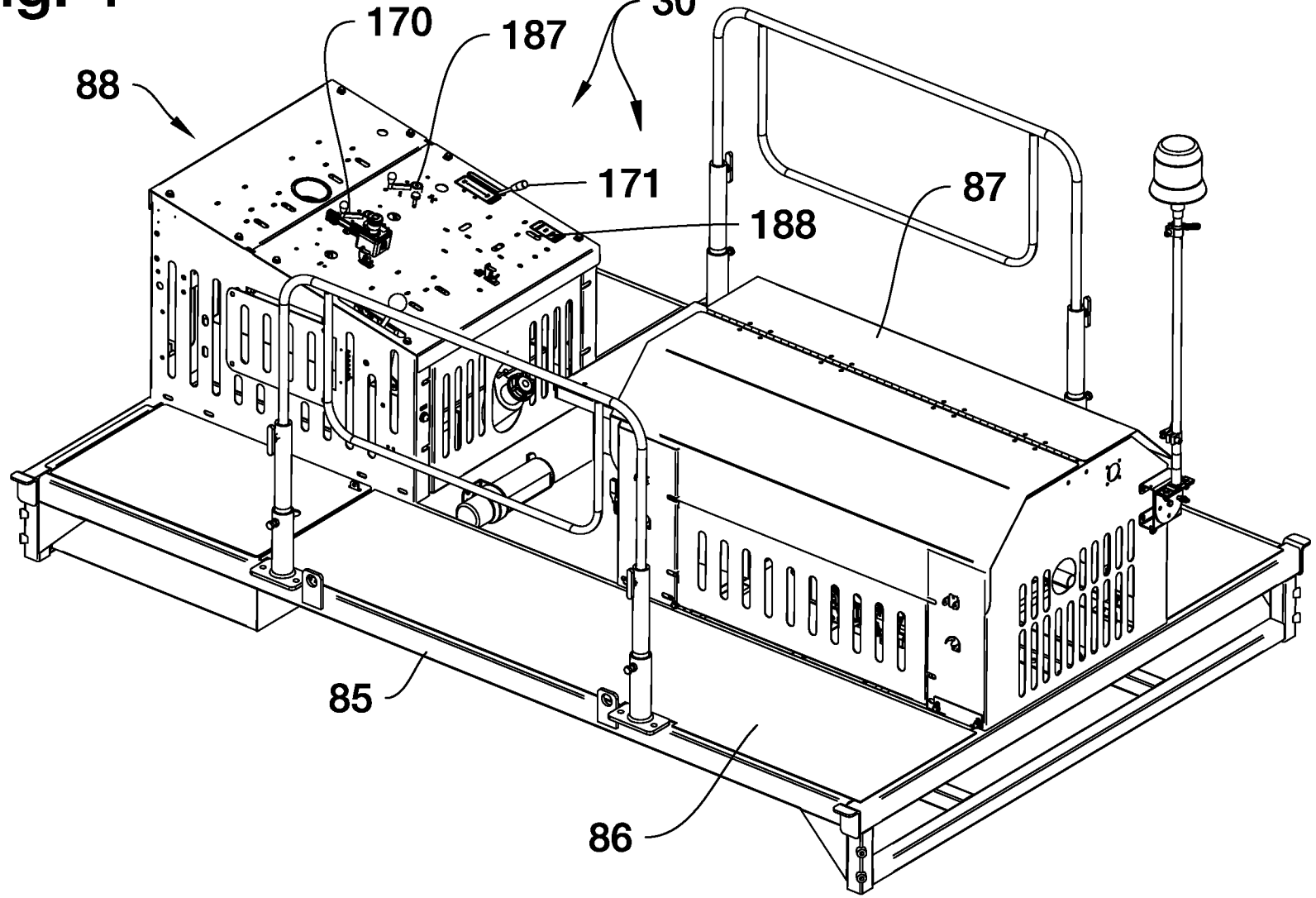
FIG. 4 is a fragmentary isometric view of the preferred operator position, with portions thereof omitted for brevity.

Referencing FIG. 4 of the drawings, a control stand 30 is preferably secured atop the frame 22 (FIG. 1) by a subframe 85 that supports a supporting floor 86 upon which a control housing 87 and operator console 88 are disposed. Suitable hydraulic controls and circuit elements discussed hereinafter when describing the hydraulic circuits may be housed within console 88 and plumbed conventionally. Drive engine and pumps may be mounted within housing 87.

Figure 5:
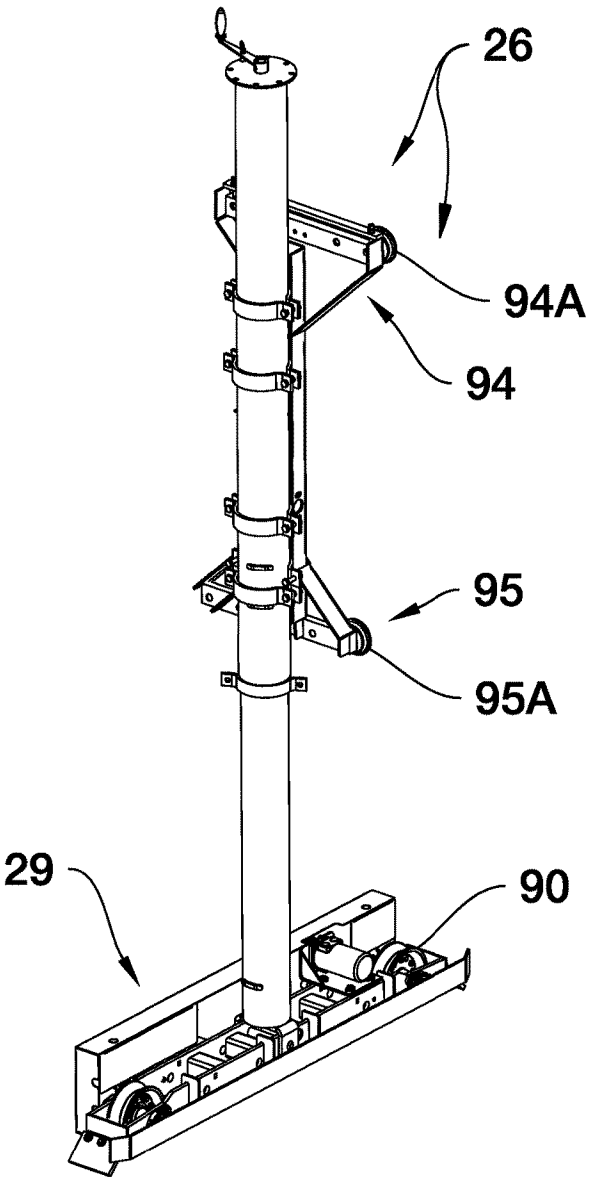
FIG. 5 is an enlarged, isometric view of a preferred supporting jack stand.

Referencing FIGS. 1A, 1B and 5, the paver 20 has a plurality of upright, adjustable jack stands 26, one at each corner of the paver 20 (FIGS. 1, 3). These jack stands 26 comprise lower, wheeled bogies 29 that may include hydraulically powered drive wheels 90 that ride along and upon suitable rails or guide tracks provided on each side of the deck 21 to be laid down. Each jack stand 26 may be secured to the paver frame 22 (i.e., an adjacent frame segment such as 22B) with a rigid jack plate 94 or 95 that may include tracking wheels 94A or 95A respectively enabling the frame 22 and/or the carriage to be adjusted in position over the work site. Each jack-stand 26 may be telescopic, enabling it to be varied in length to change frame elevation.

Figure 8A:
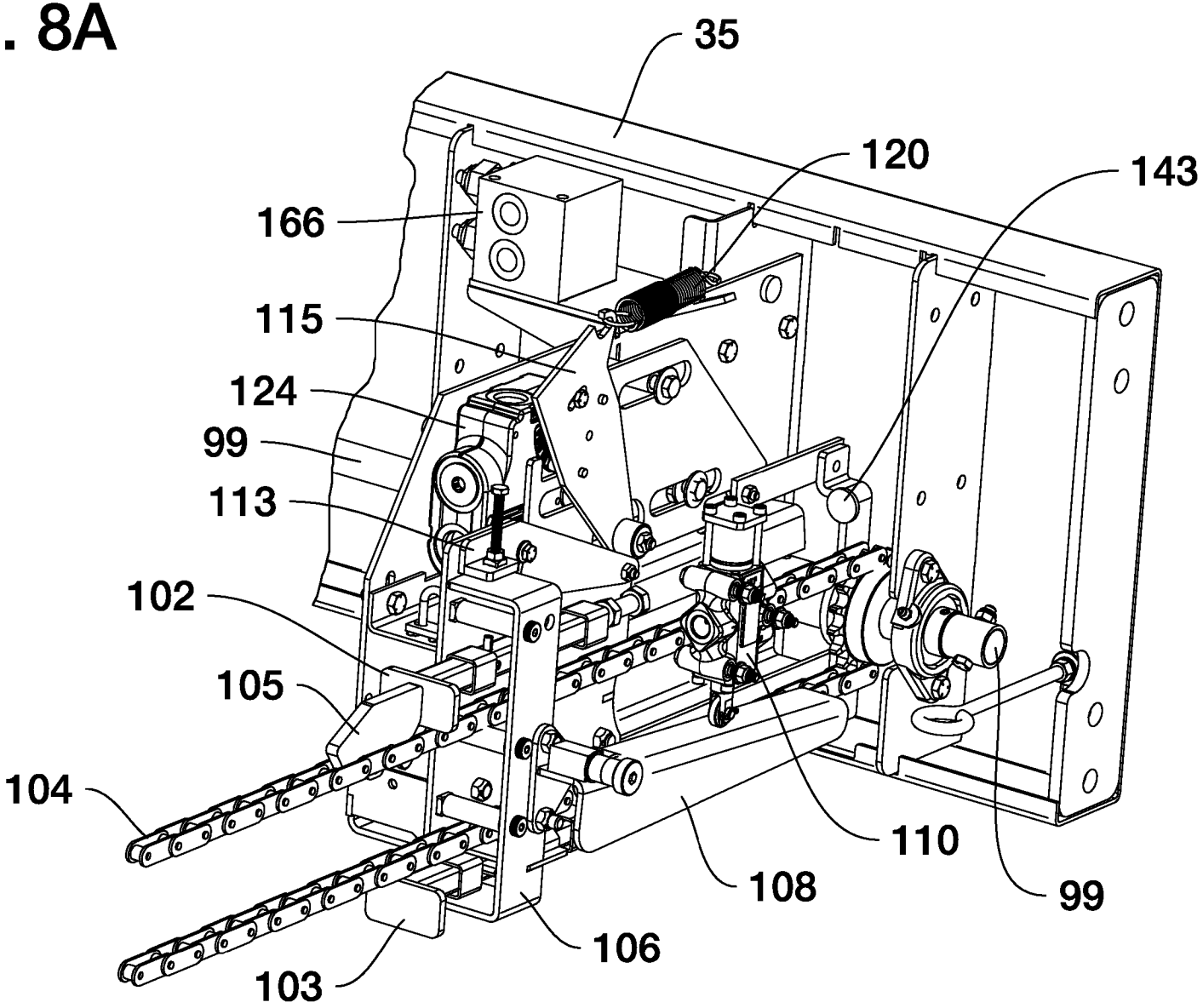
FIG. 8A is an enlarged, fragmentary isometric view similar to FIG. 6, showing hydraulic control details, with portions thereof omitted for brevity or broken away for clarity.
Figure 8B:
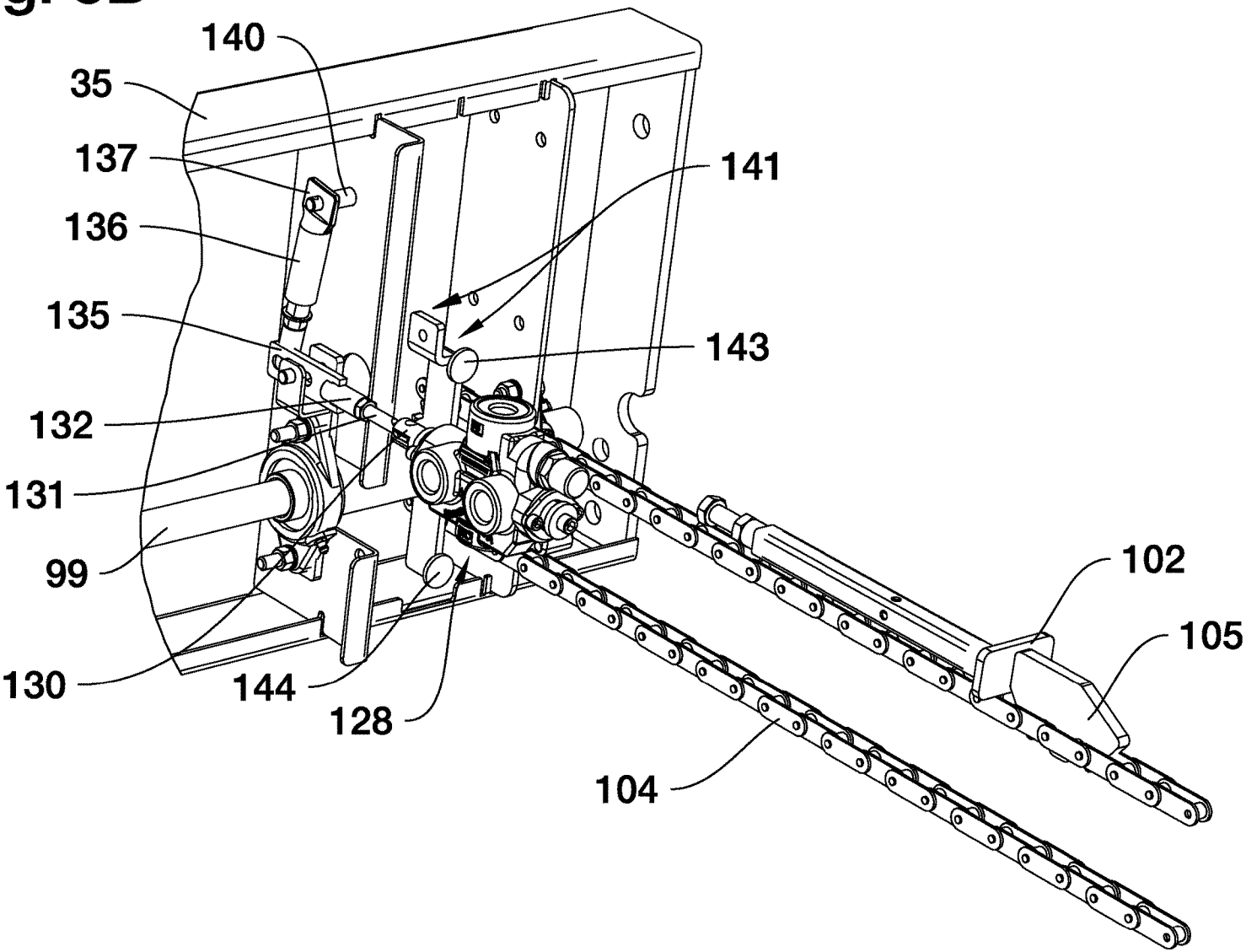
FIG. 8B is a fragmentary isometric view similar to FIG. 8A but showing opposite side details.
Figure 8C:
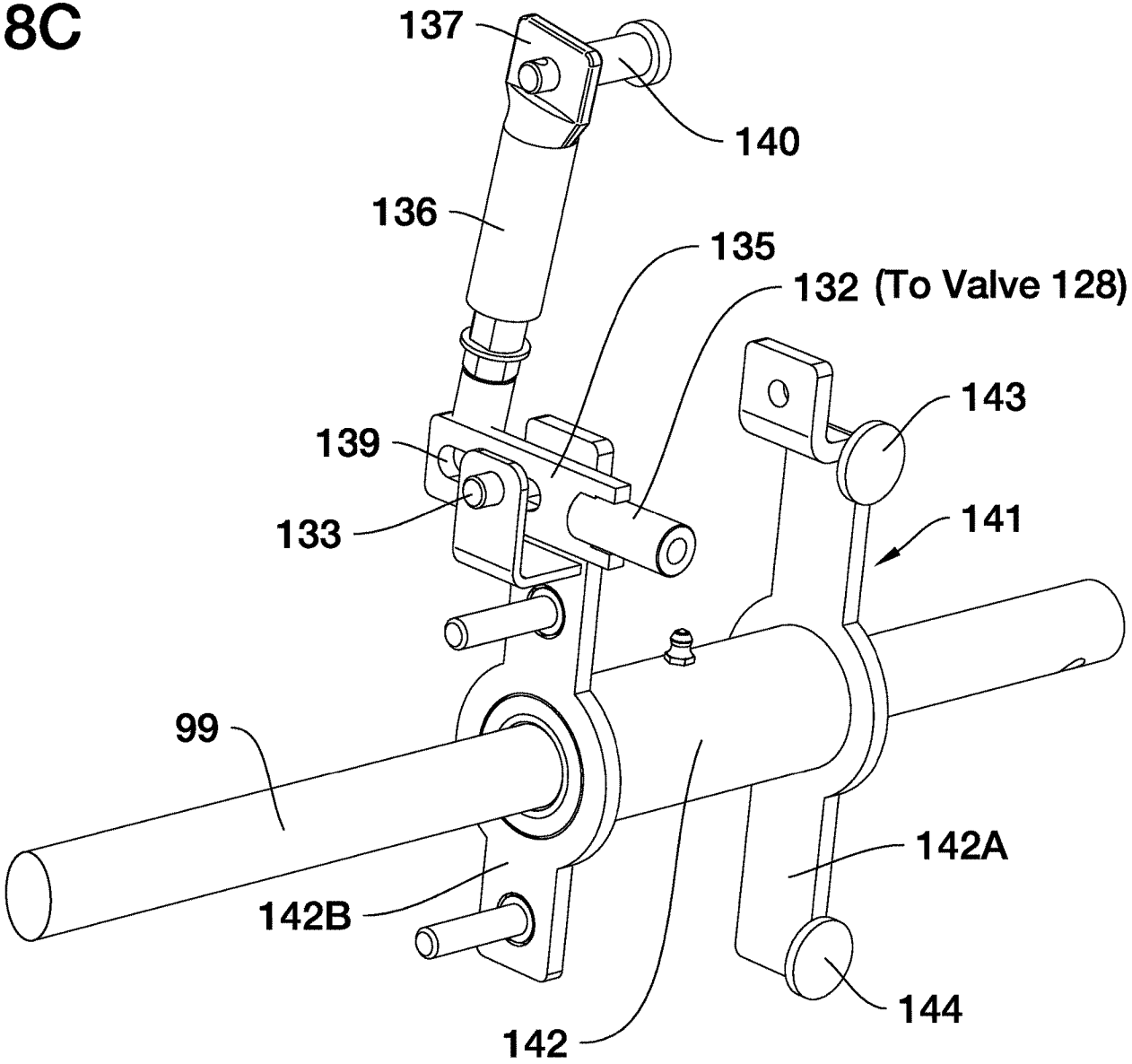
FIG. 8C is an enlarged, fragmentary isometric view showing a generally H-shaped rotatable linkage that is obscured in FIGS. 8A and 8 B.
Figure 9:
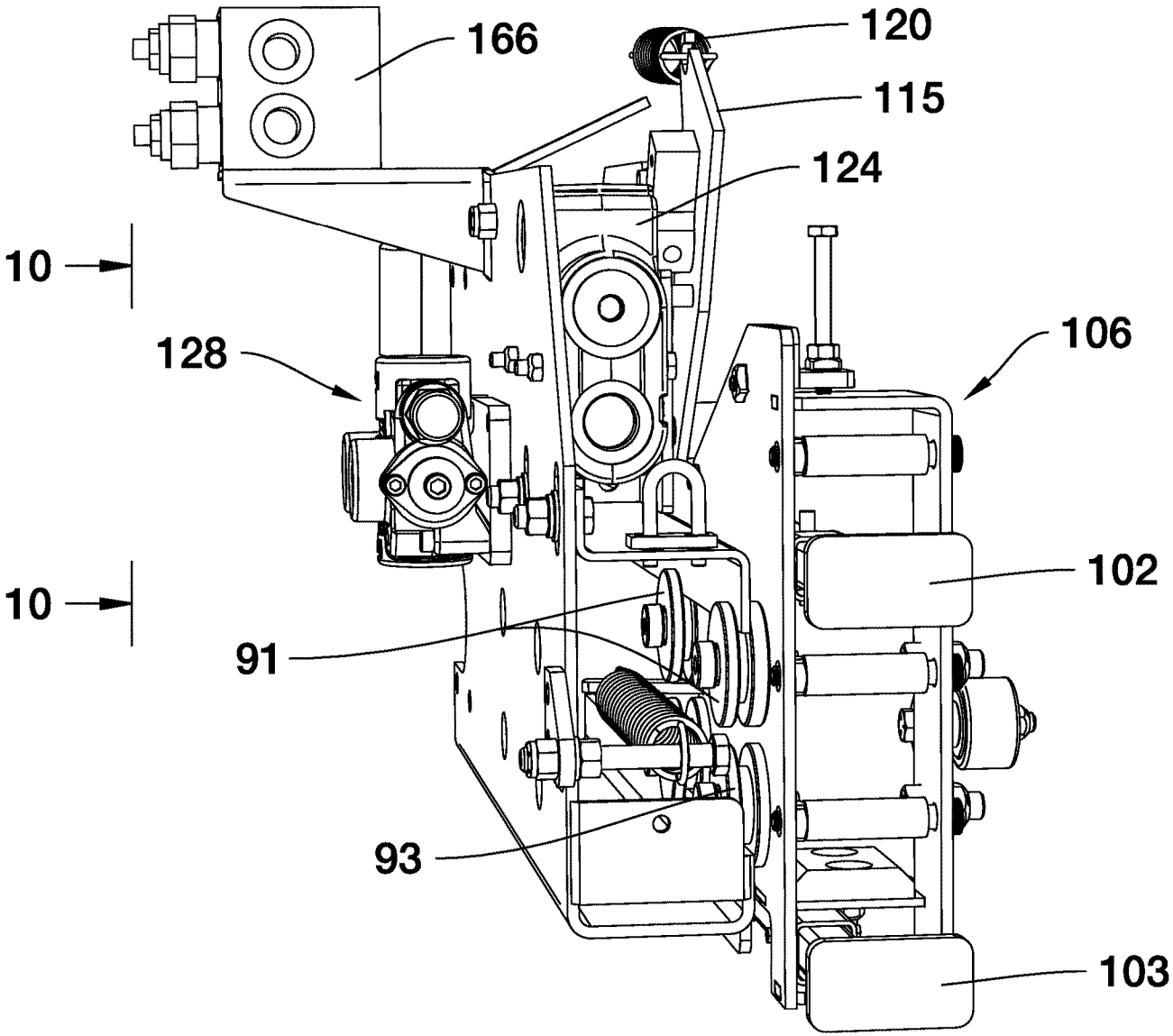
FIG. 9 is a further enlarged, fragmentary isometric view derived generally from line 9-9 in FIG. 7, showing hydraulic control details, with portions thereof omitted for brevity or broken away for clarity.

With joint reference directed to FIGS. 6-8, a section 100 of the new hydraulically driven control arrangement is disclosed. Section 100 includes an impact-driven plunger 102 which is responsive to contact with rigid trigger 105 carried by the upper portion of elongated chain 104. As chain 104 rotates clockwise (i.e., as viewed in FIG. 6) the carriage 27 moves to the right, and trigger 105 (FIGS. 6, 8) contacts plunger 102; sufficient travel of plunger 102 results in contact with linkage housing 106 that is forced to the right. Linkage housing 106 is slidably mounted with upper track wheels 91 and lower track wheels 93 for limited movement along the length of the frame (FIG. 9). Movement of housing 106 actuates plate 113 (FIG. 8A) and rotates plate 115 against pressure from spring 120 (FIG. 7) to actuate flow controlling deceleration 124 (FIGS. 7, 8A). At this time ramp 108 (FIGS. 6, 7, 8*a*-8*c*) is moved towards the right. When moving to the right (as viewed in FIG. 7) wedge-like ramp 108 lifts roller actuator/plunger 109 extending from the travel valve 110 (FIGS. 6, 7, 11) upwardly, being in contact with ramp 108 and subject to wedged displacements caused thereby. When roller actuator/plunger 109 is forced upwardly, it can actuate ground travel valve 110 (FIG. 6, 11) which ultimately results in machine travel as wheeled bogie assemblies 29 are thus activated.

The lower portion 104B of drive chain 104 (FIG. 6) mounts another trigger 107, that can hit plunger 103 on a carriage return cycle, again shifting housing 106 to the right. As plunger 103 goes in, it hits stop 144 on bracket 141 discussed below, which again actuates carriage reverse valve 128 (FIG. 8*c*) to reverse carriage travel again, subsequent to the carriage slowing down because of carriage deceleration valve 124 (FIG. 11) described below.

The hydraulic carriage motor 101 (FIGS. 6, 11) drives a pair of entrained, dual sprockets 103 (FIG. 6) that turn a carriage drive shaft 99 for rotating carriage drive chain 104. As linkage housing 106 and the ramp 108 move towards the right, the actuator/plunger 109 is thus thrust upwardly into valve 110 (i.e., FIGS. 6, 11), turning the valve "on." This enables subsequent flow to the jack stand bogie motors 180, 181 (FIG. 11), resulting in propulsion of the paver over the surface 21 being paved. This latter action must be timed properly relative to periodic transverse movements of the carriage 27. Motors 180, 181 are controlled by circuits 150A, 150B seen in FIGS. 11, 12. Rightward movement of linkage housing 106 also deflects a lever arm 113 that deflects link 115, moving it counterclockwise against predetermined force from return spring 120. When deflected fully, link 115 actuates hydraulic deceleration valve 124, that slows down carriage movement.

Figure 10:
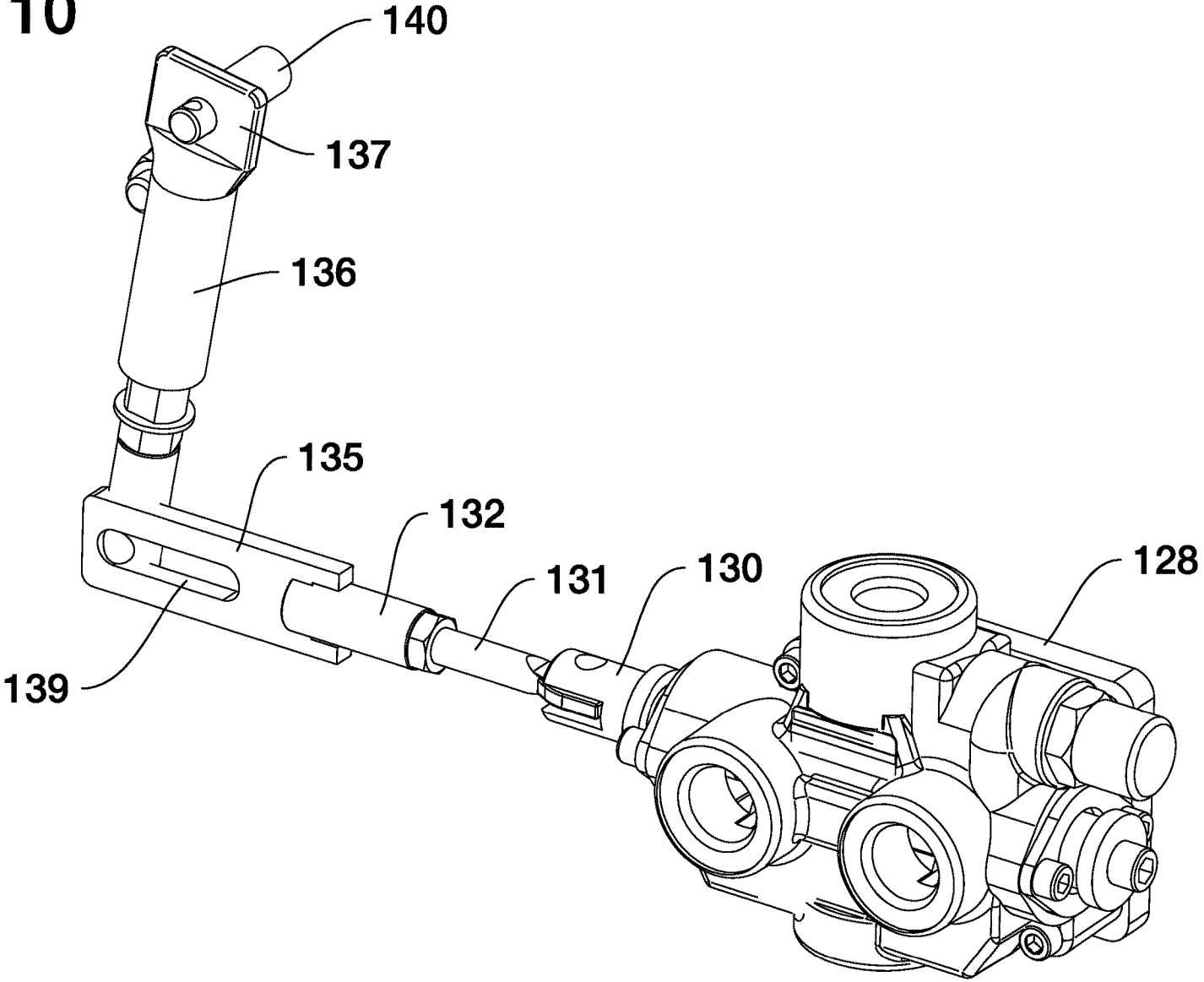
FIG. 10 is a further enlarged, fragmentary isometric view taken generally along lines 10-10 in FIG. 9, with portions thereof omitted for brevity or broken away for clarity; and, FIGS. 11 and 12 are hydraulic schematic diagrams showing the preferred hydraulic control circuitry employed by the instant invention.

Referencing FIGS. 9 and 10, the hydraulic carriage reverse valve 128 is connected through a swivel coupling 130 to carriage reverse valve 128 via a shaft 131 leading to fitting 132. Link 135 connects via standoff 136 to an apertured tab 137 from which a link 140 projects and is anchored to the chassis. A generally H-shaped bracket 141 has a central trunnion 142 supporting opposite, integral, rigid levers 142A and 142B (FIG. 8C). End bracket 142A (FIG. 8B, 8C) has an upper stop 143 and a lower stop 144. When bracket 141 is pressured at stop 143 by contact with plunger 102 (i.e., FIG. 7) bracket 141 rotates, pulling link 132 and 130 (FIG. 10) to activate carriage reverse valve 128. A slot 139 (FIGS. 8C, 10) receives a follower 133. When the carriage reverses, at the end of its opposite course another trigger disposed on the bottom portion of chain 104 will contact stop 104 and rotate bracket 141 to reverse carriage reverse valve 128, causing reversal of carriage direction.

Figure 11:
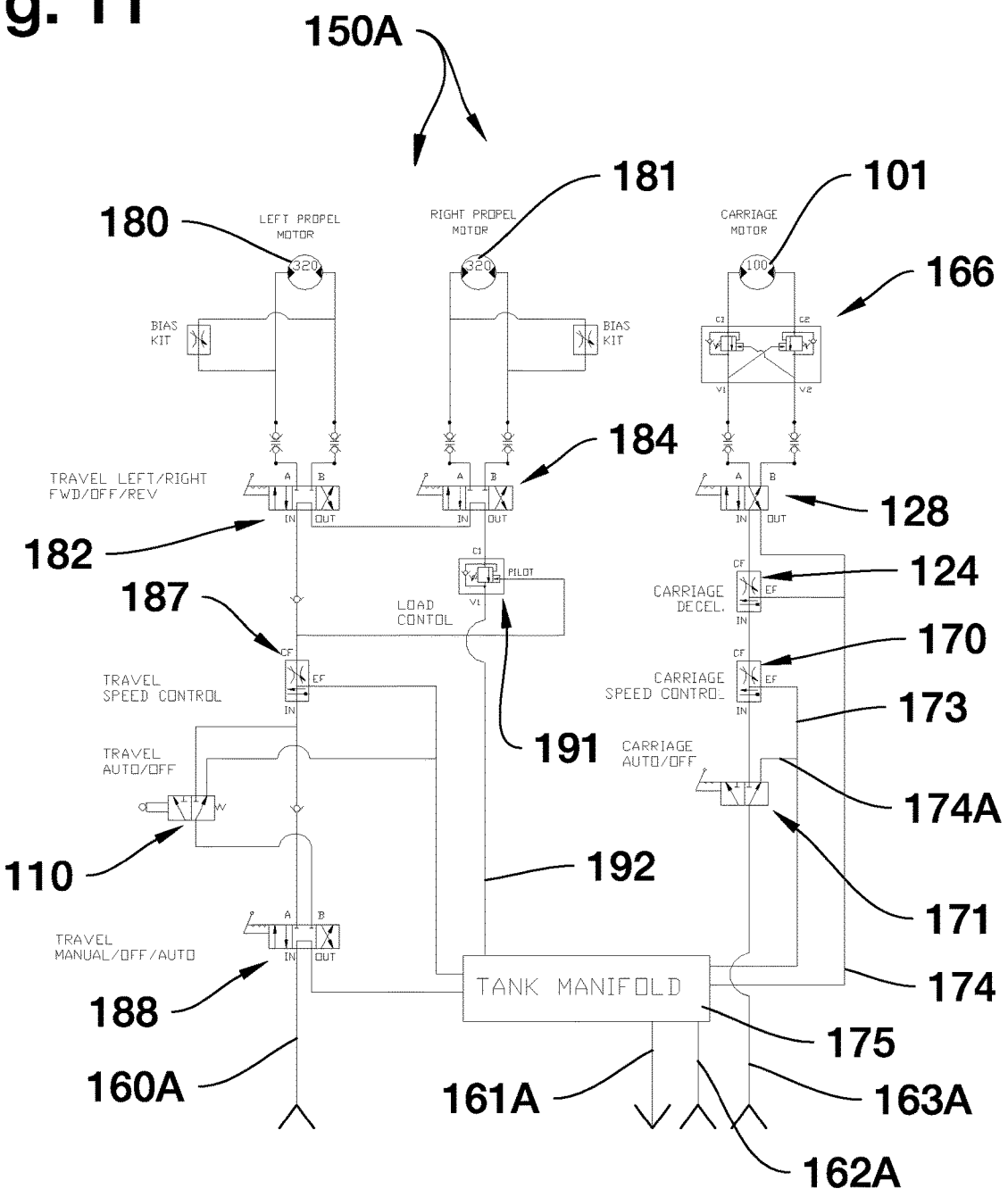
Figure 12:
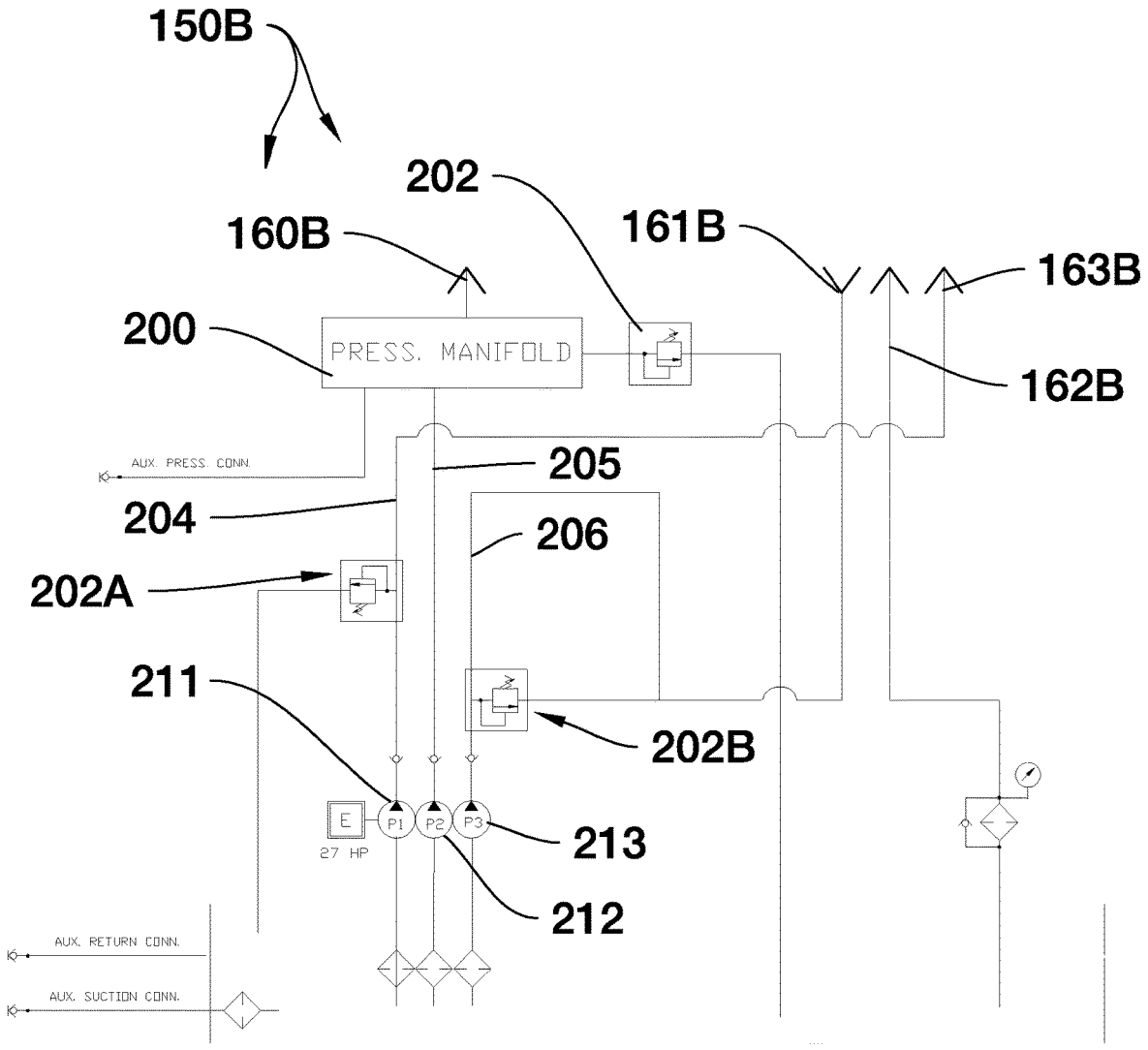

In FIGS. 11 and 12 the preferred hydraulic circuitry has been identified by the reference numerals 150A and 150B. The connections of circuit segment 150A (FIG. 11) respectively designated 160A, 161A, 162A, and 163A respectively interconnect with connections 160B, 161B, 162B and 163B (FIG. 12) respectively. Carriage motor 101 (FIGS. 10, 11) communicates with a carriage counterbalance valve 166 which is connected to carriage reverse valve 128 controlled by mechanical movements discussed above. Carriage deceleration valve 124 and carriage speed control valve 170 connect to carriage "auto/off" valve 171 for manually stopping influencing carriage travel, and to output line 163A. Deceleration valve 124 dampens carriage shocks during the repetitive carriage direction changing process as the carriage reciprocates over the frame. Return lines 173, 174 and 174A run to tank manifold 175.

Ground travel propulsion motors 180 and 181 (FIG. 11) drive the machine 20 along the path of the surface being treated. They are mounted with a pair of spaced-apart ground travel bogies 29A and 29B (FIG. 1A). connect to lever directional valves 182 and 184. A line from flow control 187 runs to directional valve 182 and then directional valve 184 which leads to load control valve 191. Valves 182 and 184 control and synchronize motors 180, 181 to control the direction of machine travel. Ground drive valve 110 (FIGS. 6 and 11) can be actuated by ramp action (i.e, form ramp/wedge 108, FIG. 6) to start and/or stop machine travel independently of valve 188 below, valve 188 is in the "auto" position. Valve 188 allows hydraulic flow for selection of a "manual" or "off" or "auto" travel setting. When auto selection valve 188 is selected, valve 110 allows travel in a preselected direction of either forward or reverse dictated by valves 182 and 184. Directional valves 182 and 184 lead to travel holding valve 191 which returns to tank 175 via a line 192.

In FIG. 12 a pressure manifold 200 leads to a relief valve 202. Lines 204, 205 and 206 respectively lead to pumps 211, 212, and 213. Relief valve 202A is connected to pump 211 and relief valve 202B is connected to pump 213.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations.

As many possible embodiments may be made of the invention without departing from the scope thereof, it is to be understood that all matter herein set forth or shown in the accompanying drawings is to be interpreted as illustrative and not in a limiting sense.

What is claimed is:

1. An automated paver for treating bridge decks and roadways, the paver comprising:
- a rigid, elongated frame adapted to be disposed over a bridge deck or roadway being treated;
- a plurality of vertically upright stanchions for moving and supporting said frame;
- a movable carriage adapted to be slidably displaced along the frame;
- a chain for selectively moving the carriage;
- means for displacing the chain and thus the carriage;
- a treatment head suspended from said carriage for engaging and treating raw concrete;
- and,
- hydraulic circuit means for controlling the paver, the hydraulic circuit means comprising:
  - a carriage drive motor for actuating said chain;
  - a carriage reversing valve for reversing the carriage drive motor and thus said carriage;
  - a carriage deceleration valve for dampening carriage movements prior to carriage reversing;
- a hydraulic ground propulsion motor for each support stanchion;
- a reversing valve for controlling each of said hydraulic ground propulsion motors; and,
- a hydraulic ground travel valve connected to said reversing valve for powering said hydraulic ground propulsion motors.

2. The paver as defined in claim 1 further comprising ramp means for actuating said hydraulic circuit means in response to predetermined chain movement.

3. The paver as defined in claim 1 further comprising:
- an impact-driven plunger responsive to contact with a rigid trigger mounted upon said chain for actuating deceleration valve prior to carriage travel reversal and for reversing the direction of carriage travel;
- means associated with said chain for mechanically actuating said ground travel valve after said deceleration valve is actuated; and,
- means responsive to chain movement for actuating said carriage drive motor.

4. The paver as defined in claim 3 wherein the finishing head comprises at least one finishing auger, a vibrating roller-surfacer, and at least one roller tube oriented generally transversely to the frame.

5. The paver as defined in claim 3 further wherein the roller-surfacer comprises a hydraulic vibrator to densify concrete.

6. The paver as defined in claim 5 further comprising ramp means for actuating said hydraulic circuit means in response to predetermined chain movement.

7. An automated paver for treating bridge decks and roadways, the paver comprising:
- a rigid, elongated frame adapted to be disposed over a bridge deck or roadway being treated;
- a plurality of vertically upright jack stands for moving and supporting said frame;
- a movable carriage adapted to be slidably displaced along the frame;
- a revolvable chain for displacing the carriage;
- a treatment head suspended from said carriage for engaging and treating raw concrete;
- hydraulic circuit means for controlling the paver, the hydraulic circuit means comprising:
  - a carriage drive motor for revolving said chain;
  - a carriage reversing valve for reversing the carriage drive motor and thus said carriage;
  - a carriage deceleration valve for dampening carriage movements prior to carriage reversing;
  - a hydraulic ground propulsion motor for each support jack stand;
  - a reversing valve for controlling each of said propulsion motors;
  - a hydraulic ground travel valve connected to said reversing valve for powering said propulsion motors;
  - an impact-driven plunger responsive to contact with a rigid trigger mounted upon said chain for actuating said deceleration valve prior to carriage travel reversal for reversing the direction of carriage travel;
  - means associated with said chain for mechanically actuating said ground travel valve after said deceleration valve is actuated; and,
  - means responsive to chain movement for actuating said carriage drive motor.

8. The paver as defined in claim 7 further comprising ramp means for actuating said hydraulic circuit means in response to predetermined chain movement.

9. The paver as defined in claim 8 wherein the finishing head comprises at least one finishing auger, a vibrating roller-surfacer, and at least one roller tube oriented generally transversely to the frame.

10. The paver as defined in claim 9 further wherein the roller-surfacer comprises a hydraulic vibrator to densify concrete.

* * * * *